US008167153B1

(12) United States Patent
Wattel

(10) Patent No.: US 8,167,153 B1
(45) Date of Patent: May 1, 2012

(54) HOIST PLATFORM AND SCAFFOLDING ATTACHMENT MEANS

(76) Inventor: Garry Wattel, Kerwood (CA)

( * ) Notice: Subject to any disclaimer, the term of this patent is extended or adjusted under 35 U.S.C. 154(b) by 192 days.

(21) Appl. No.: 12/633,448

(22) Filed: Dec. 8, 2009

Related U.S. Application Data

(60) Provisional application No. 61/201,124, filed on Dec. 8, 2008.

(51) Int. Cl.
*B66D 3/18* (2006.01)

(52) U.S. Cl. ..... 212/271; 212/179; 182/45

(58) Field of Classification Search ..... 212/271
See application file for complete search history.

(56) References Cited

U.S. PATENT DOCUMENTS

| | | | | |
|---|---|---|---|---|
| 2,616,768 | A | 11/1852 | Stemm | |
| 232,556 | A * | 9/1880 | Silvius | 182/45 |
| 1,650,324 | A * | 11/1927 | Campbell | 248/237 |
| 3,217,896 | A | 11/1965 | Cannella | |
| 4,098,371 | A | 7/1978 | Cox | |
| 4,386,680 | A * | 6/1983 | Reed | 182/142 |
| 4,560,074 | A | 12/1985 | Manning | |
| 5,207,337 | A | 5/1993 | Massey | |
| 5,341,898 | A * | 8/1994 | Baziuk | 182/142 |
| 5,960,904 | A * | 10/1999 | Ullmann | 182/45 |
| 6,135,300 | A | 10/2000 | Fox | |
| 6,782,972 | B1 * | 8/2004 | Hatch et al. | 182/102 |
| 6,983,856 | B1 | 1/2006 | Burks | |
| 7,044,313 | B2 | 5/2006 | Haliburda, III | |
| 2005/0236352 | A1 * | 10/2005 | Tien | 212/179 |

* cited by examiner

*Primary Examiner* — Michael Mansen
*Assistant Examiner* — Juan Campos, Jr.
(74) *Attorney, Agent, or Firm* — Montgomery Patent & Design, LLC; Robert C. Montgomery; Joseph T. Yaksich

(57) ABSTRACT

A support system for use on mast climbing scaffolding systems comprising a plate system with integral fastening components that attach along outer edges of a horizontal surface of the scaffolding assembly is herein disclosed. The system is utilized to mount a hoisting device to lift building tools, supplies and materials. The system may be folded thereinto a compact configuration for transport between job sites.

19 Claims, 6 Drawing Sheets

HOIST PLATFORM AND SCAFFOLDING ATTACHMENT MEANS

RELATED APPLICATIONS

The present invention was first described in and claims the benefit of U.S. Provisional Application No. 61/201,124, filed Dec. 8, 2008, the entire disclosures of which are incorporated herein by reference.

FIELD OF THE INVENTION

The present invention relates generally to hoists utilized in construction applications, and in particular, to a transportable hoist platform and scaffolding attachment means for such hoists.

BACKGROUND OF THE INVENTION

Portable, adjustable scaffolding schemes are a common method utilized in construction sites. Such systems allow for customizable semi-permanent accessibility to otherwise difficult to manage portions of construction sites. Furthermore, small cranes are often utilized in order to move bulky, heavy materials throughout a construction site. A benefit of such cranes is that they provide the capacity to move materials vertically as well as horizontally. While small objects and tools may be transported manually throughout a scaffolding system, large and heavy objects and materials are difficult to manage without mechanical assistance. Cranes are particularly well adapted to moving such materials throughout a construction site and to desired locations within a scaffolding system.

While such cranes are undeniably useful for construction applications, they can be difficult or unwieldy in many situations. The process of situating a crane can be difficult and time consuming. This makes it impractical or difficult to move materials over large distances. In addition, when many materials must be moved in succession and in a variety of different locations, much time is lost by the inability of cranes to be positioned in advantageous locations due to site constraints. In many cases, a paucity of space in a crowded construction site can make it difficult or impossible to work cranes in a constricted space where the cranes would be most beneficial.

Various attempts have been made to provide portable or adaptable cranes or scaffolds for construction applications. Examples of these attempts can be seen by reference to several U.S. patents. U.S. Pat. No. 2,616,768, issued in the name of Stemm, describes a crane support movable self-leveling scaffold. The Stemm apparatus provides a portable section of scaffolding which is mechanically adjusted by means of a supporting crane assembly.

U.S. Pat. No. 3,217,896, issued in the name of Cannella, describes a self-elevating building crane. The Cannella apparatus is a crane with an integral support system which allows the base of the crane to be adjusted in a vertical manner.

U.S. Pat. No. 6,135,300, issued in the name of Fox, describes a parapet-mounted hoist. The Fox apparatus includes a cradle which is mountable to a parapet and a boom oriented perpendicularly to the cradle.

While these devices fulfill their respective, particular objectives, each of these references suffer from one (1) or more of the aforementioned disadvantages. Many such apparatuses are unfeasible when scaffolding or another desired location for material movement is particularly narrow. Also, many such apparatuses are not suitably stable to allow movement of heavy materials safely. In addition, many such apparatuses are not retrofittable and adaptable to various existing models of construction cranes. Furthermore, many such apparatuses are not easily transportable and attachable for expedited movement of materials about a construction site. Finally, many such apparatuses are not mountable to existing sections of scaffolding as necessary. Accordingly, there exists a need for a crane platform and scaffolding attachment without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need to provide a time efficient and stable crane support platform which is adaptable for attachment to existing construction cranes and securely mountable to scaffolding. Thus, the object of the present invention is to solve the aforementioned disadvantages and provide for this need.

To achieve the above objectives, it is an object of the present invention to comprise an assembly of plates with integral fastening components which enable secure attachment to a walking surface of a scaffolding assembly. The system comprises a hoist mounting plate which allows attachment of a hoisting device for the movement of building tools, supplies, and the like. The system further comprises three folding sections which allow the system to be folded compactly and transported between job sites using common trucks or trailers.

Another object of the present invention is to provide a stable interconnecting means between a hoisting device and a common mast climbing scaffolding assembly. The system comprises a main platform, a first connecting plate assembly, and a second connecting plate assembly.

Yet still another object of the present invention is to comprise the main platform of a rugged weldment which further comprises an internal welded support member and a plurality of thick welded steel plates which form a pallet-like rectangular structure. The steel plate elements form standard forklift apertures along all four side surface to provide a convenient means of transport using a forklift or similar lifting equipment. The main platform further comprises a hoist mounting plate welded at a central location.

Yet still another object of the present invention is to comprise the main platform of first and second pairs of hinges arranged along a common center line in a linear fashion. The first hinges provide rotating attachment to the first connecting plate assembly, and the second hinges provide rotating attachment to the second connecting plate assembly. The connecting plate assemblies extend from the main platform to form a large coplanar torsion bearing structure. The hinges also provide a compact folding, storage, and transportation means.

Yet still another object of the present invention is to comprise the first connecting plate assembly of a welded box-like structure with identical width and thickness as the main platform. The first connecting plate assembly further comprises a first top plate which extends from the main platform top plate and a first face plate welded to the first top plate portion at a right angle extending downwardly. When installed, the first face plate is positioned parallel to a vertical side portion of the scaffolding assembly.

Yet still another object of the present invention is to comprise the first face plate of a pair of bar apertures, a plurality of locking ears, a pair of outrigger hinges, and a pair of handrail mounts. These provide a means to securely attach a forward edge of the system to the scaffolding. The handrail mounts are welded to upper outer corners of the first face plate and comprises section of steel structural tubing which receive a safety railing portion of the scaffolding assembly.

Yet still another object of the present invention is to comprise the second connecting plate assembly of a welded structure with a rearward extending trapezoidal-shaped cross section. The second connecting plate assembly comprises an identical width as the main platform and provides a three part top surface which allows equipment and personnel to easily travel over the system and continue along the scaffolding assembly. The second connecting plate assembly further provides similar construction and attachment means to the scaffolding assembly as the first connecting plate assembly.

Yet still another object of the present invention is to further comprise the second connecting plate assembly of a second face plate welded along a top rear edge at a right angle extending downwardly. The second face plate provides a weldment comprising a pair of bar apertures, a pair of outrigger hinges, a plurality of second locking ears, and a pair of handrail mounts employed similarly to the first face plate.

Yet still another object of the present invention is to provide additional features for the positioning and storage of auxiliary equipment including a pair of equipment anchoring apertures and a rectangular storage box welded along an edge of the main platform top plate. The apertures comprise holes drilled through the main platform top plate which provide an anchoring or attachment means to various auxiliary equipment. The storage box comprises a section of rectangular structural tubing primarily suited to store a plurality of anchoring bars.

Yet still another object of the present invention is to provide rotating deployment of the connecting plate assemblies from the main platform during installation at a job site by means of the first and second hinges. The first connecting plate assembly is deployed on the side facing nearest to a building. Due to the shorter length of the first connecting plate assembly, the hoisting device is positioned at an offset position toward a building structure. The hoist mounting plate may be modified by a user to include carious fastening features such as drilled holes, welded studs, and the like to comply with various hoisting devices.

Yet still another object of the present invention is to further comprise each connecting plate assembly of a pair of outrigger hinges, a third outrigger, and a fourth outrigger. The outrigger hinges provide a hinging means between the face plates and outriggers to extend the outriggers to a position coplanar with the respective face plate. Each outrigger comprises rugged rectangular steel plates which establish a widened bearing surface to increase the torsional strength of the system once attached to a scaffolding assembly.

Yet still another object of the present invention is to provide secure anchoring of the system via the inserting and securing of anchoring bar portions of a scaffolding assembly through bar apertures portions of the face plates and outriggers, and subsequent insertion into corresponding features of the scaffolding assembly. The anchoring bars are secured in place by inserting a locking rod perpendicularly, securing the system in all four corner locations.

Yet still another object of the present invention is to provide a compact folding means using the first and second hinges to produce an upward folding motion. When in a compact folded state, the connecting plate assemblies are rotated upwardly to a generally vertical orientation. This results in a footprint of less than half of the deployed horizontal footprint, allowing for compact storage and convenient transport.

Yet still another object of the present invention is to comprise rigging features to safely retain the system in the folded state. These features include a pair of first rigging plates welded into the main platform with rigging apertures drilled through. The rigging apertures enable the connecting plate assemblies to be secured to each other via attachment of various binding means such as chain binders, cable-binders, stiffener rods, and the like. The outrigger hinges provide a hinging means to fold the outriggers inward to a compact position.

Yet still another object of the present invention is to comprise four (4) wheel assemblies which comprises heavy-duty wheels and rugged connecting brackets which are removably attachable to the first and second connecting plate assemblies at lower corners of the system. The wheels provide a means of conveniently maneuvering the system across a paved surface.

Yet still another object of the present invention is to provide a method of utilizing the device that provides a unique means of easily and quickly transporting the system to a desired location, securely affixing the system to a desired section of a scaffolding assembly, securely attaching a hoisting device for use in the desired location, and quickly and easily compacting and transporting the system after use.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
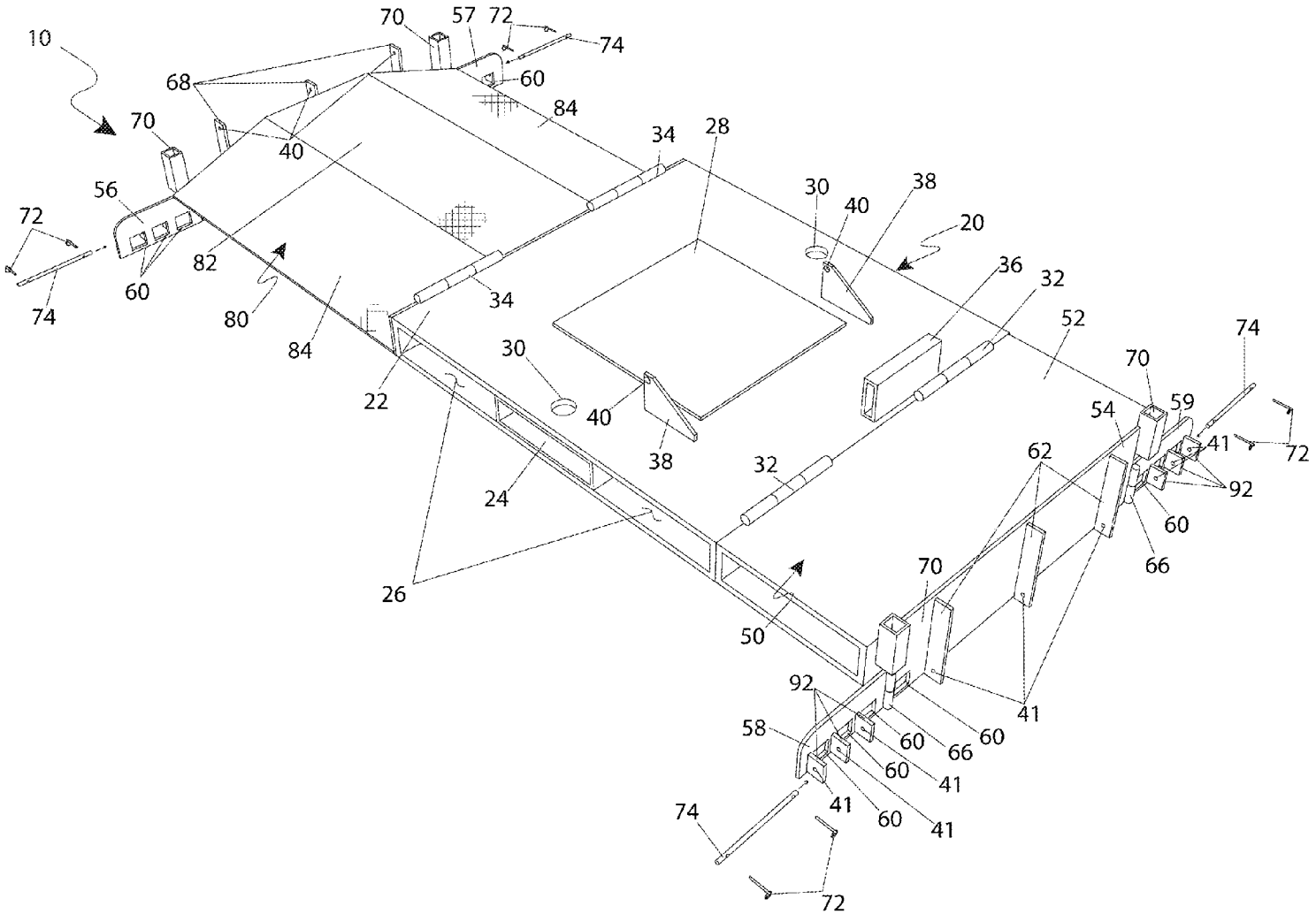
FIG. 1 is a front perspective view of a hoist platform and scaffolding attachment means 10, according to a preferred embodiment of the present invention.

| | |
|---|---|
| 10 | hoist platform |
| 20 | main platform |
| 22 | main platform top plate |
| 24 | support member |
| 26 | forklift aperture |
| 28 | hoist mounting plate |
| 30 | equipment anchoring aperture |
| 32 | first hinge |

-continued

| | |
|---|---|
| 34 | second hinge |
| 36 | storage box |
| 38 | rigging plate |
| 40 | rigging aperture |
| 41 | locking rod aperture |
| 50 | first connecting plate assembly |
| 52 | first top plate |
| 54 | first face plate |
| 56 | first outrigger |
| 57 | second outrigger |
| 58 | third outrigger |
| 59 | fourth outrigger |
| 60 | bar aperture |
| 62 | first locking ear |
| 66 | outrigger hinge |
| 68 | second locking ear |
| 70 | handrail mount |
| 72 | locking rod |
| 74 | quick-release pin |
| 80 | second connecting plate assembly |
| 82 | second top plate |
| 84 | inclined plate |
| 86 | second face plate |
| 92 | third locking ear |
| 95 | wheel assembly |
| 96 | common fastener |
| 120 | scaffolding assembly |
| 122 | anchoring bar |
| 124 | anchor bar aperture |
| 125 | hoisting device |
| 130 | railing |
| 200 | building structure |

DETAILED DESCRIPTION OF THE PREFERRED EMBODIMENT

The best mode for carrying out the invention is presented in terms of its preferred embodiment, herein depicted within FIGS. 1 through 5*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a hoist platform and scaffolding attachment means (herein described as the "system") 10, to secure a common hoisting device 125 thereto a mast climbing scaffolding assembly 120. The system 10 comprises an assembly of plates with integral fastening components enabling secure attachment thereto said scaffolding assembly 120 along inner and outer edges and thereto a walking surface portion of said scaffolding assembly 120. The system 10 also comprises a hoist mounting plate 28 to facilitate mounting of the hoisting device 125 thereupon, thereby enabling a user to hoist building tools, supplies, and other materials associated with a construction site. The system 10 comprises three (3) folding sections allowing the system 10 to be folded compactly and transported between job sites using a common truck or trailer.

Figure 2:
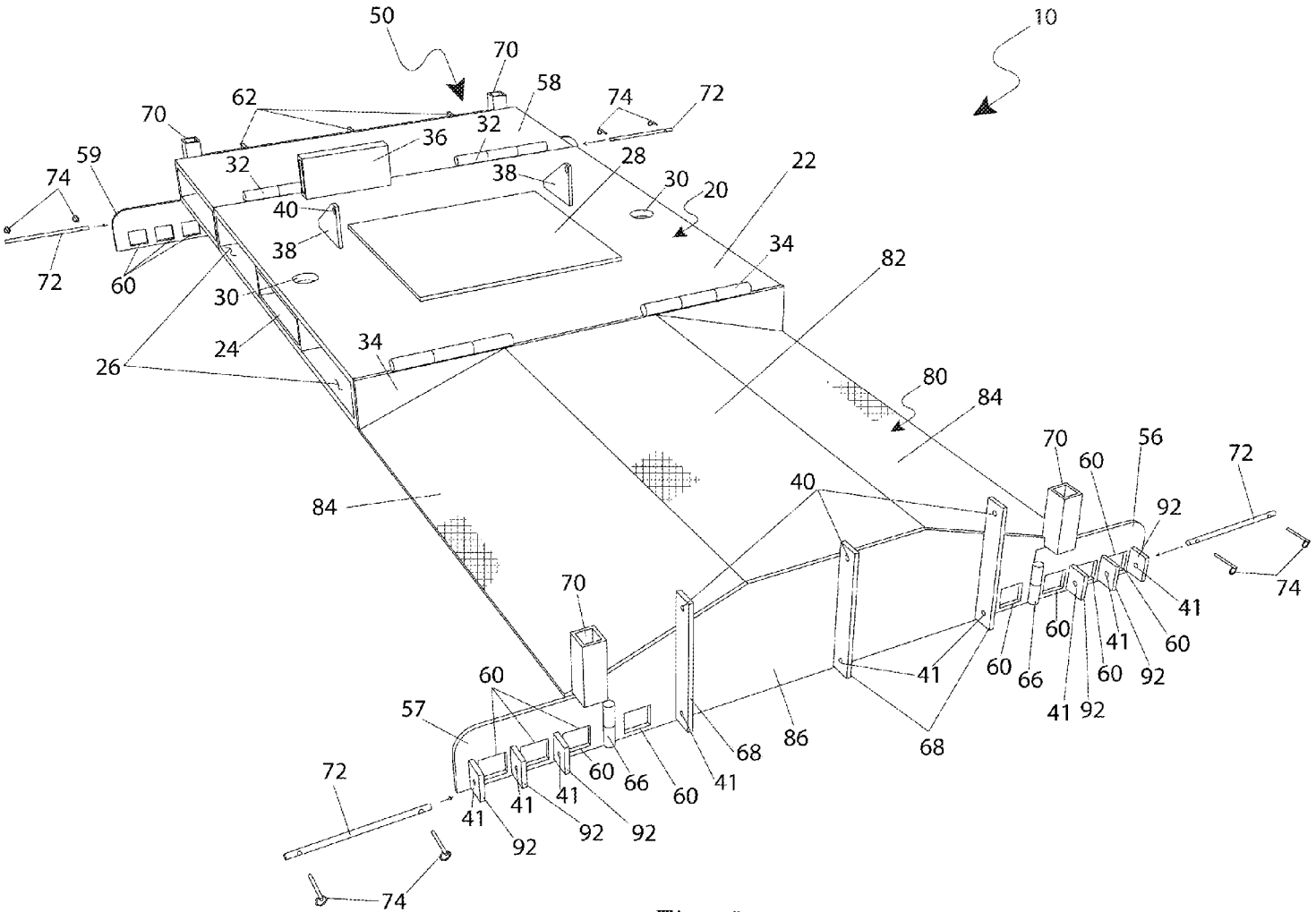
FIG. 2 is a rear perspective view of the hoist platform and scaffolding attachment means 10, according to a preferred embodiment of the present invention.

Referring now to FIGS. 1 and 2, perspective views of the system 10, according to the preferred embodiment of the present invention, are disclosed. The system 10 provides a stable interconnecting means therebetween a hoisting device 125 and a mast climbing scaffolding assembly 120 being common in the industry, thereby allowing a user to lift and position a variety of heavy objects associated with a construction site such as, but not limited to: building tools, supplies, large stones, bricks, and the like. The system 10 comprises a main platform 20, a first connecting plate assembly 50, and a second connecting plate assembly 80. The main platform 20 comprises a rugged weldment comprising an internal welded support member 24 comprising a section of structural tubing, and a plurality of thick welded steel plates to form a pallet-like rectangular structure approximately three (3) to four (4) feet on a side and approximately six (6) inches high. The steel plate elements of the main platform 20 are arranged to form standard rectangular forklift apertures 26 along all four (4) side surfaces which provide a convenient means to transport the system 10 using a forklift or similar lifting and transporting equipment. The main platform 20 comprises a main platform top plate 22 further comprising a hoist mounting plate 28 welded thereat a central location along said main platform top plate portion 22 to facilitate mounting of a hoisting device 125 thereupon, as well as provide additional torsional strength thereto the main platform 20. Along forward and rearward edges of the main platform 20 are respective pairs of first hinges 32 and second hinges 34. Each pair of hinges 32, 34 is arranged along a common center line in a linear fashion, comprising common heavy-duty three (3) element rotating units having an interior rotating pin being enclosed therein horizontal cylindrical sleeves which are welded thereto upper opposing edges of said main platform 20. The first hinges 32 provide a rotating attachment means thereto a first connecting plate assembly 50 which extends horizontally in a forward direction therefrom the main platform 20. The second hinges 34 provide a similar rotating attachment means thereto a second connecting plate assembly 80 which extends therefrom an opposing edge. The connecting plate assemblies 50, 80 extend therefrom the main platform 20, thereby defining a large coplanar torsion bearing structure. The connecting plate assemblies 50, 80 provide strong attachment of the system 10 thereto the scaffolding assembly 120 along outer edges being capable of withstanding anticipated torsional forces and loading associated therewith hoisting of equipment and materials at a construction site. The first 32 and second 34 hinges also provide a compact folding, storage, and transporting means thereto the system 10 (see FIGS. 5*a* and 5*b*).

The first connecting plate assembly 50 comprises a welded box-like structure having an identical width and thickness as said main platform 20 being made using similar materials and fabrication methods. The first connecting plate assembly 50 comprises a first top plate 52 which extends therefrom and being coplanar therewith the main platform top plate 22 approximately twelve (12) inches. The first connecting plate assembly 50 comprises a first face plate 54 welded thereto the first top plate portion 52 at a right angle and extending downwardly therefrom approximately twelve (12) inches. When installed thereupon the aforementioned mast climbing scaffolding assembly 120 and in a coplanar position with respect to the main platform 20, said first face plate 54 is positioned parallel to and adjacent thereto a vertical side portion of the scaffolding assembly 120 being attached thereto using a first outrigger 56 and a second outrigger 58 (see FIG. 4). The first face plate 54 comprises a rigid weldment further comprising a pair of bar apertures 60, a plurality of first locking ears 62, a pair of outrigger hinges 66, and a pair of handrail mounts 70. The bar apertures 60, first locking ears 62, and outrigger hinges 66 provide a means to securely attach a forward edge of the system 10 thereto the scaffolding assembly 120 (see FIG. 4). The handrail mounts 70 are welded thereto upper outer corners of the first face plate 54 and comprise sections of structural steel tubing comprising an inner opening sized so as to receive a safety railing portion 130 of the scaffolding assembly 120 thereinto.

The second connecting plate assembly 80 comprises a welded structure having a trapezoidal-shaped cross section extending in a rearward direction approximately four (4) feet. Said second connecting plate assembly 80 comprises an identical width as the main platform 20 and is to be made using similar materials and fabrication methods as well. The second connecting plate assembly 80 provides a three (3) part top surface comprising a central horizontal second top plate 82 which angles downwardly along outer side edges at approximately thirty (30) degrees to form a pair of inclined plates 84, thereby allowing various equipment and personnel to transverse the second connecting plate assembly 80 and continue along the scaffolding assembly 120. Said second top plate 82 and inclined plates 84 are envisioned to be made using rugged steel plate having a textured surface such as "fish-plate" or the like. The second connecting plate assembly 80 provides similar construction and attachment means thereto the scaffold assembly 120 as the previously described first connecting plate assembly 50. The second connecting plate assembly 80 comprises a second face plate 86 being welded therealong a top rear edge at a right angle and extending downwardly therefrom approximately twelve (12) inches. When the second connecting plate assembly 80 is in a coplanar position with respect to the main platform 20, said second face plate 86 is positioned parallel to, and adjacent thereto a rear portion of the scaffolding assembly 120 being farthest away from the building structure 200. The second face plate 86 provides a weldment comprising a pair of bar apertures 60, a pair of outrigger hinges 66, a pair of handrail mounts 70, and a plurality of second locking ears 68. The bar apertures 60, second locking ears 68, and outrigger hinges 66 provide a similar attachment function thereto the scaffolding assembly 120 as the previously described first face plate 54 (see FIG. 4).

The system 10 also provides additional features for the positioning and storage of auxiliary equipment including a pair of equipment anchoring apertures 30 and a rectangular storage box 36 welded along an edge portion of the main platform top plate 22. The equipment anchoring apertures 30 comprise holes approximately two (2) inches in diameter drilled through a main platform top plate 22 being located thereat an intermediate position along outer edges. Said equipment anchoring apertures 30 provide an anchoring and/or attachment means thereto various auxiliary equipment such as, but not limited to: a hoist hydraulic control box, or other equipment and tools used in conjunction with the system 10 during operation. The open-ended rectangular storage box 36 comprising a section of rectangular structural tubing positioned horizontally and having an opening size of approximately three (3) inches wide by approximately twelve (12) inches high being primarily suited to store a plurality of anchoring bars 122 (see FIG. 4); however, it is understood that said storage box 36 may be sized and/or utilized to store or retain various related scaffolding assembly 120 equipment and tools based upon a user's preference.

Figure 3:
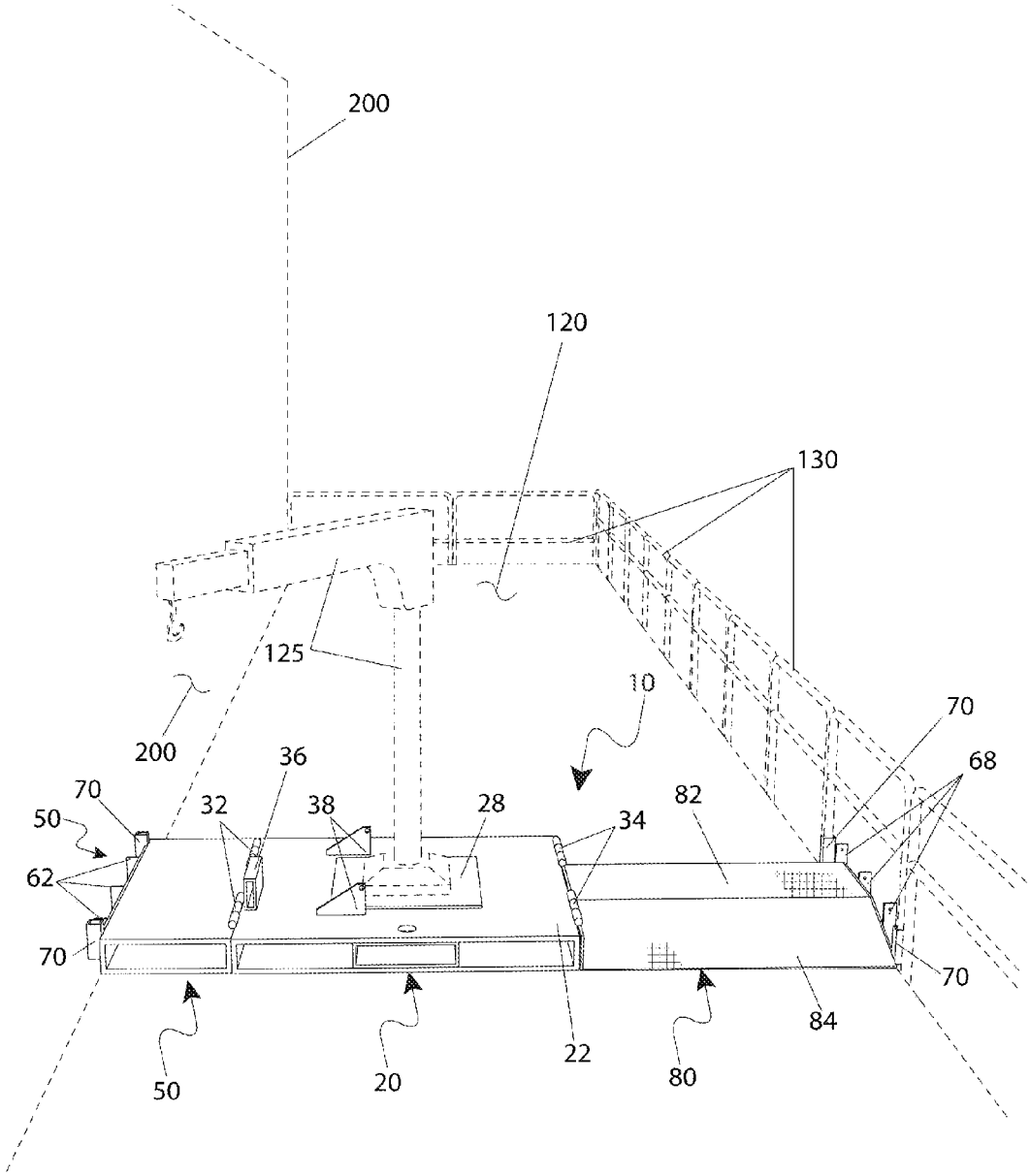
FIG. 3 is an environmental view of the hoist platform and scaffolding attachment means 10 depicting usage thereupon a scaffolding assembly 120, according to a preferred embodiment of the present invention.

Referring now to FIG. 3, an environmental view of the system 10, according to a preferred embodiment of the present invention, is disclosed. The first 32 and second 34 hinges provide rotating deployment of the connecting plate assemblies 50, 80 therefrom the main platform 20 during installation at a job site. When deployed, the first connecting plate assembly 50 extends downwardly over a forward edge of the scaffold assembly 120 nearest to a building structure 200 while the second connecting plate assembly 80 extends downwardly over an opposing outer edge of said scaffold assembly 120, thereby securing a lateral position of the system 10. Due to the shorter length of the first connecting plate assembly 50, the hoisting device 125 once mounted thereto the system 10, is positioned thereat an offset position toward a building structure 200. The handrail mounts 70 may be utilized to receive vertical elements of a safety railing portion 130 of the scaffold assembly 120 along forward and/or rearward edges.

It is envisioned that the hoist mounting plate 28 may be modified by a user to include various fastening features such as drilled holes, welded studs, brackets, or the like to comply thereto particular attachment requirements of various hoisting devices 125.

Figure 4:
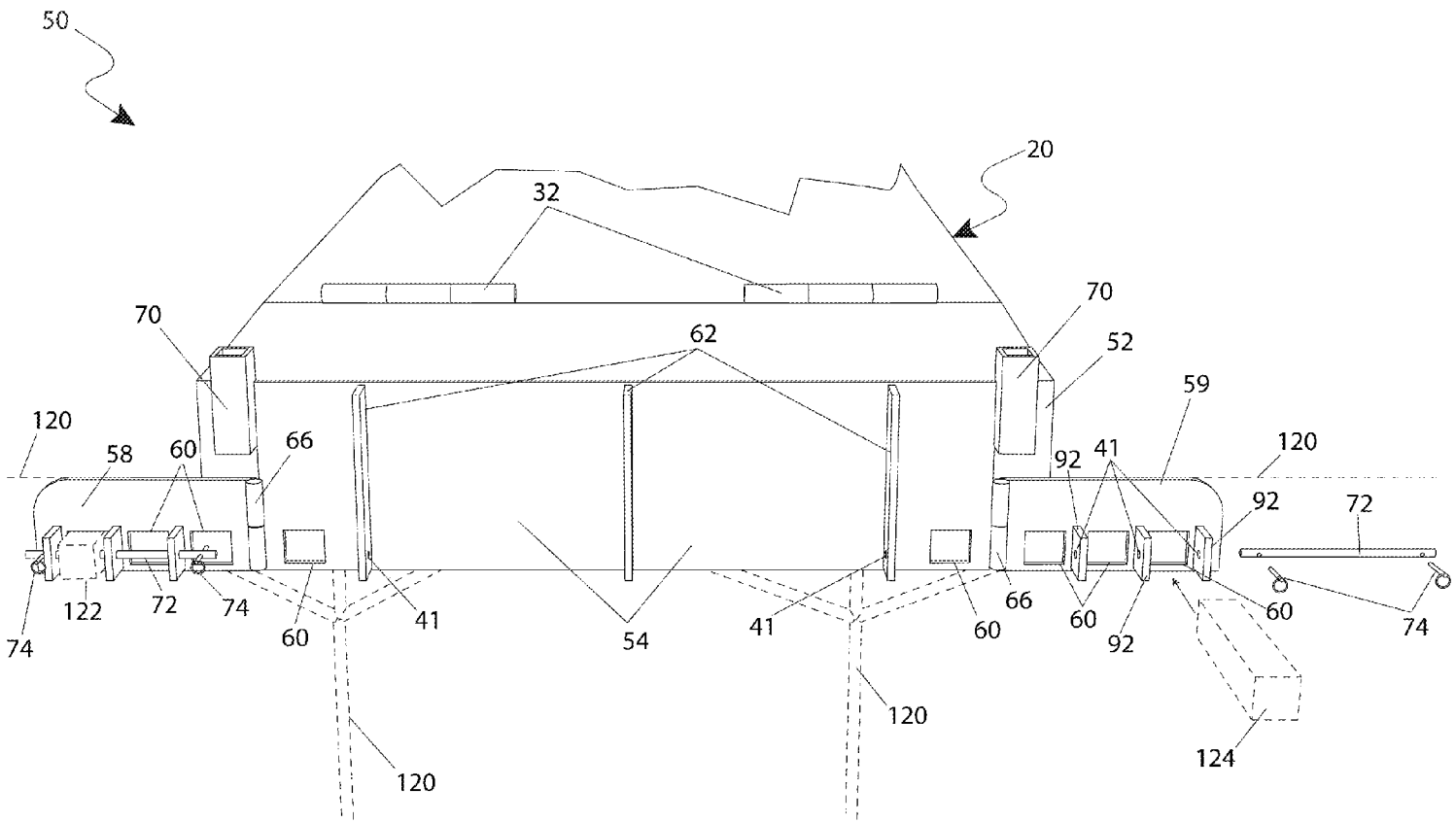
FIG. 4 is a perspective view of a first connecting plate assembly portion 50 of the hoist platform and scaffolding attachment means 10, according to a preferred embodiment of the present invention.

Referring now to FIG. 4, a perspective view of a first connecting plate assembly portion 50 of the system 10, according to a preferred embodiment of the present invention, is disclosed. The first connecting plate assembly 50 further comprises a pair of outrigger hinges 66, a third outrigger 58, and a fourth outrigger 59. In like manner, the second connecting plate assembly 80 comprises a pair of outrigger hinges 66, a first outrigger 56, and a second outrigger 57, thereby providing respective right-hand and left-hand extensions of said first 54 and second 86 face plates along outer edges. For simplicity sake, only the first connecting plate 50 is illustrated herein. The outrigger hinges 66 provide a hinging means therebetween said face plates 54, 86 and the outriggers 56, 57, 58, 59 to extend said outriggers 56, 57, 58, 59 outwardly thereto a position being coplanar therewith the respective face plate 54, 86. Said outrigger hinges 66 comprise common heavy-duty two (2) element units being welded thereto respective first face plate 54 and outrigger portions 56, 57, 58, 59. Each outrigger 56, 57, 58, 59 comprises rugged rectangular steel plates approximately one-half (½) inch thick and twelve (12) inches long. Each outrigger 56, 57, 58, 59 is hingedly deployed outwardly being coplanar therewith the first face plate 54, thereby establishing a widened bearing surface to increase the torsional strength of the system 10 once attached thereto the scaffold assembly 120.

Secure anchoring of the system 10 thereto the scaffold assembly 120 is accomplished via inserting and securing of anchoring bars 122 or "smart-bar" portions of the scaffold assembly 120 therethrough bar aperture portions 60 of the face plates 54, 86 and outriggers 56, 57, 58, 59 and subsequent insertion thereinto corresponding features of the scaffold assembly 120. Subsequently, said anchoring bars 122 are secured in place by inserting a locking rod 72 perpendicularly therethrough. Each bar aperture 60 comprises a rectangular opening therethrough an outrigger 56, 57, 58, 59 or face plate 54, 86 being sized so as to receive an anchoring bar 122 portion of the scaffold assembly 120 therethrough. Said anchoring bar 122 is subsequently inserted thereinto a corresponding aperture feature of the scaffolding assembly 120 being aligned therewith said bar aperture 60, thereby securing the system 10 thereto the scaffolding assembly 120 at all four (4) corner locations.

The face plates 54, 86 and outriggers 56, 57, 58, 59 provide a securing means to hold the anchoring bars 122 in an inserted position via a plurality of third locking ears 92 and inserted locking rods 72. Each third locking ear 92 comprises a centrally located locking rod aperture 41. The aforementioned first face plate 54 comprises the first locking ears 62 also comprising centrally located locking rod apertures 41. As previously described, the second face plate 86 comprises a plurality of second locking ears 68 also having locking rod apertures 41 which enable securement of the anchoring bars 122 in like manner (see FIG. 2). The locking rod apertures 41 are arranged and aligned along a common center line so as to allow insertion of a locking rod 72 therethrough the locking rod apertures 41 and coincidentally therethrough an anchoring bar aperture portion 124 of each inserted anchoring bar 122, thereby holding said anchoring bar 122 in position. Finally, said locking rods 72 are secured using common quick-release pins 74 being inserted therethrough end portions of said locking rods 72.

Figure 5A:
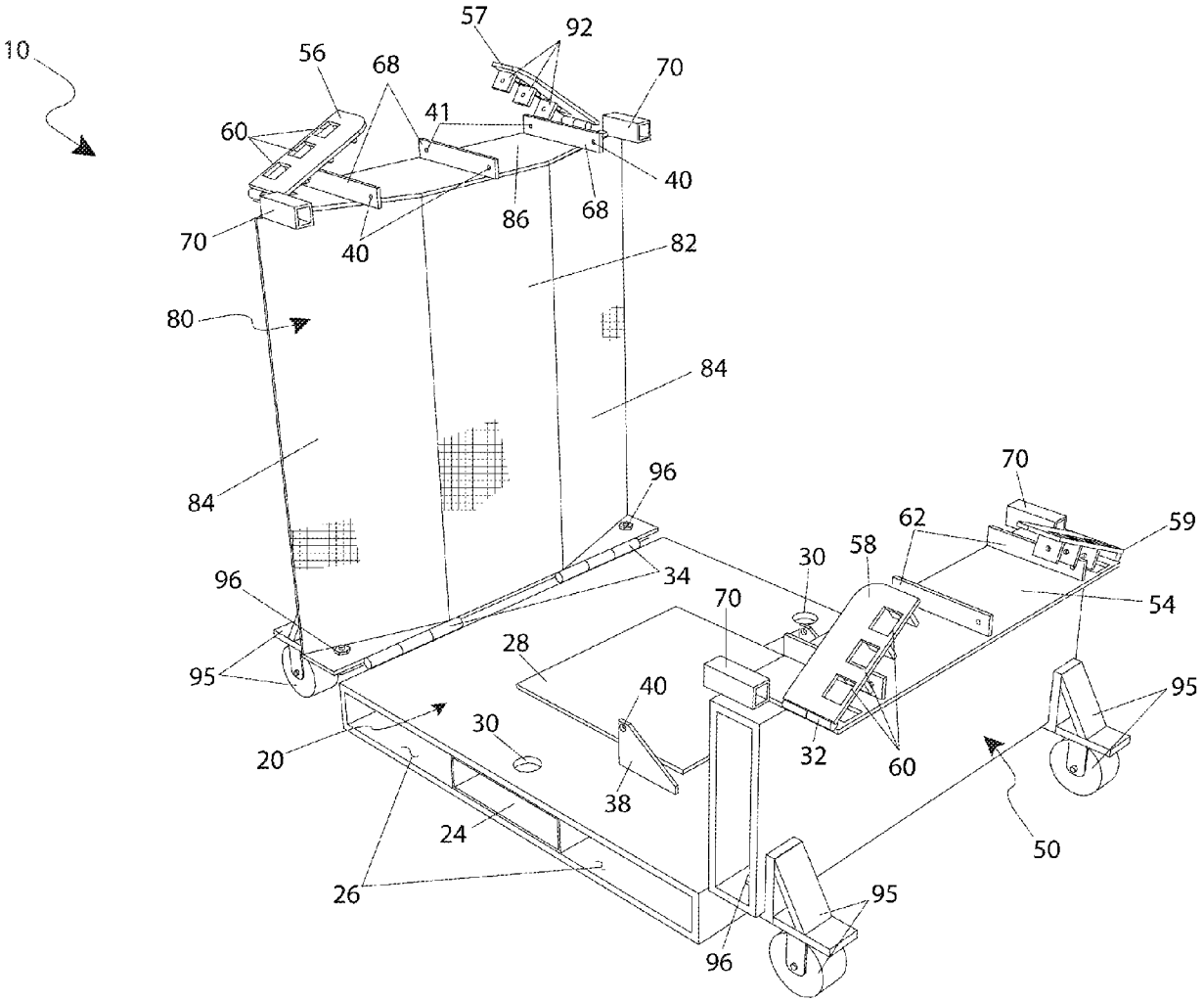
FIG. 5*a* is a front perspective view of the hoist platform and scaffolding attachment means 10 depicting a compact folded state, according to a preferred embodiment of the present invention; and, FIG. 5*b* is a rear perspective view of the hoist platform and scaffolding attachment means 10 depicting a compact folded state, according to a preferred embodiment of the present invention.
Figure 5B:
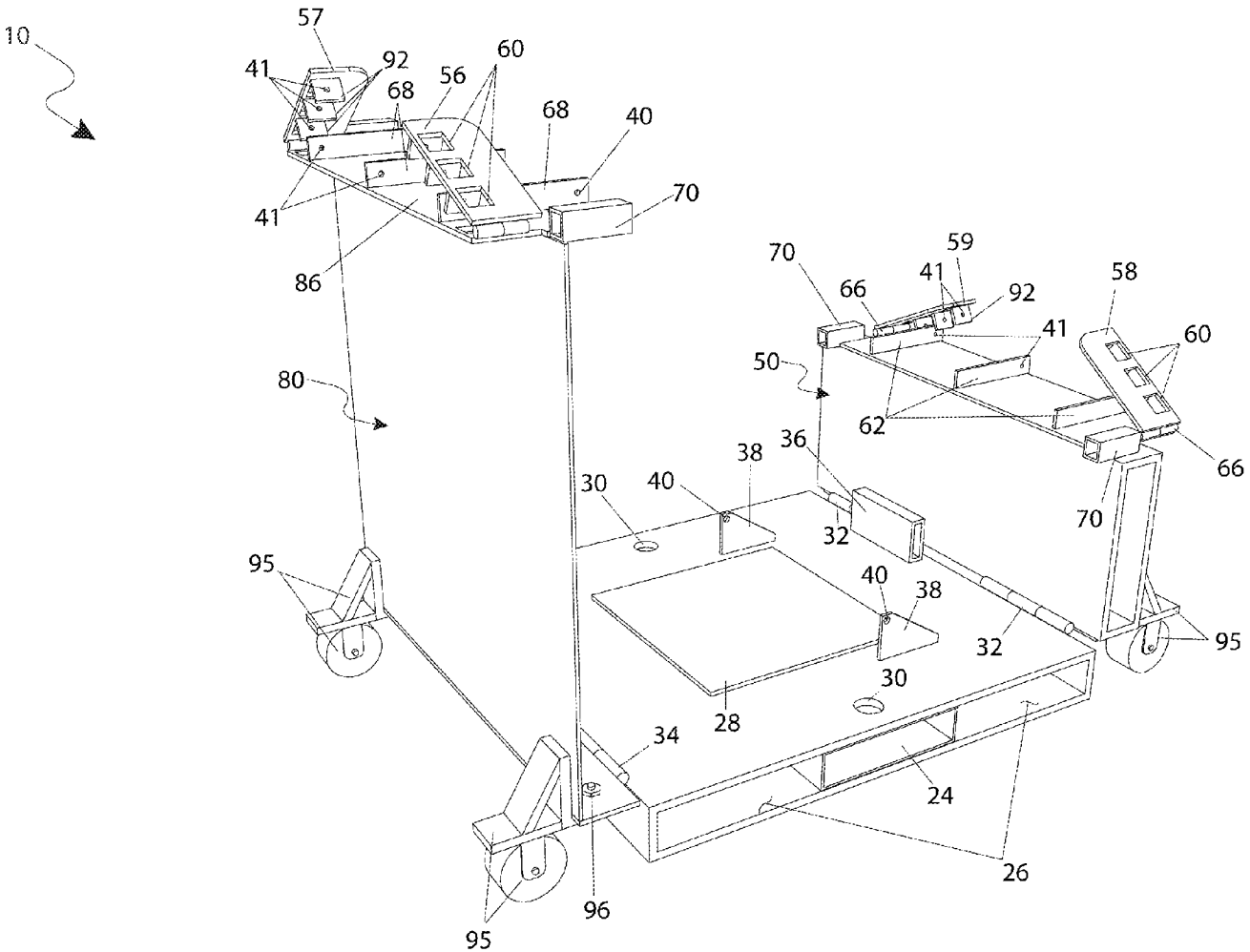

Referring now to FIGS. 5*a* and 5*b*, a front and rear perspective views of the system 10 depicting a compact folded state, according to a preferred embodiment of the present invention, are disclosed. The system 10 provides a compact folding means using the first 32 and second 34 hinges to produce an upward folding motion, thereby allowing convenient storage and transportation. The first hinges 32 and second hinges 34 provide rotating attachment thereto respective first 50 and second 80 connecting plate assemblies. When in a compact folded state, the first 50 and second 80 connecting plate assemblies are rotated upwardly about said hinges 32, 34 thereto a generally vertical orientation resulting in a reduced footprint being less than half of the previously described deployed horizontal footprint, thereby allowing for compact storage and convenient transportation thereof.

Additionally, the system 10 comprises particular rigging features to safely retaining the system 10 therein the folded state including a pair of rigging plates 38 being welded thereto the main platform 20 having respective rigging apertures 40 drilled therethrough. Additional rigging apertures 40 are integral thereto the aforementioned second locking ears 68. Said rigging apertures 40 enable said first 50 and second 80 connecting plate assemblies to be secured thereto each other via attachment of various binding means such as, but not limited to: chain binders, cable-binders, stiffener rods, and the like, to be secured thereto opposing pairs of rigging apertures 40 or other suitable features. It is understood that the system 10 is not limited to the particular rigging means illustrated here and that various features, brackets, and other attachment points may be welded, bolted, or otherwise incorporated thereinto the system 10 for retention therein the folded state without deviating from the concept and as such should not be interpreted as a limiting factor of the system 10.

The outrigger hinges 66 provide a hinging means therebetween said face plates 54, 86 and respective outriggers 56, 57, 58, 59 to compactly fold the outriggers 56, 57, 58, 59 inwardly thereto a compact position.

The system comprises four (4) wheel assemblies 95 which provide convenient maneuvering of the system 10 across a paved surface. Said wheel assemblies 95 comprise heavy-duty plastic, rubber, or metal wheels and rugged connecting brackets being removably attachable thereto the first 50 and second 80 connecting plate assemblies thereat lower corner locations of the system 10 and being mounted and utilized while said system 10 is in the previously described folded state, and are to be affixed thereto using common nut and bolt fasteners 96.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by a qualified construction specialist following minimal training. After initial purchase or acquisition of the system 10, it would be installed as indicated in FIGS. 1, 2 and 3.

The method of utilizing the system 10 may be achieved by performing the following steps: mounting the hoisting device 125 thereto the hoist mounting plate portion 28 of the main platform 20, if not previously installed; motioning the first 50 and second 80 connecting plate assemblies upwardly about the first 32 and second 34 hinges, thereby providing a compact folded state; hoisting the system 10 thereupon a mast climbing scaffolding assembly 120 using conventional forklift machinery by utilizing the integral forklift apertures 26; positioning the system 10 along said scaffolding assembly 120 with respect thereto an anticipated lifting or supporting task; pivoting the outriggers 56, 57, 58, 59 outwardly about the outrigger hinges 66 thereto a coplanar orientation; deploying the first 50 and second 80 connecting plate assemblies therefrom a vertical folded state downwardly thereto a horizontal position such that the outriggers 56, 57, 58, 59 are positioned parallel and adjacent thereto inner and outer vertical faces of the scaffolding assembly 120; motioning the system 10 longitudinally along the scaffolding assembly 120 as required to align the bar apertures 60 therewith corresponding features of said scaffolding assembly 120; inserting one (1) or more locking bars 50 at each corner location of the system 10; securing the first 50 and second 80 connecting plate assemblies into position by inserting the anchoring bars 122 thereinto the bar apertures 60 and corresponding features of the scaffolding assembly 120; securing the anchoring bars 122 thereto an inserted longitudinal position by inserting respective locking rods 72 therethrough the locking rod aperture portions 41 of the face plates 54, 86 and outriggers 56, 57, 58, 59; securing said locking rods 72 using the quick-release pins 74; utilizing the attached lifting device portion 125 in a normal manner to perform various hoisting tasks associated with a building project; repositioning the system 10 as needed therealong the scaffolding assembly 120 as described above, as needed, until completion of a project; removing the locking rods 72 and returning the system 10 thereto a folded state using the first 32 and second 34 hinges; moving the system 10 between job sites and/or transporting said system 10 using a truck or trailer; and, benefiting from convenient hoisting capability upon a mast climbing type scaffolding assembly 120 to vertically transport or hoist building materials, tools, and supplies during the performance of a construction project using the present invention 10.

The system 10 may also be easily moved along a paved surface as desired by bolting the wheel assemblies 95 thereto the connecting plate assemblies 50, 80.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A support system for construction equipment, further comprising:

a main platform, further comprising:

an internal support member comprising a section of structural tubing;

a plurality of plates forming a rectangular structure arranged to form forklift apertures along side surfaces of said main platform; and, a main platform top plate affixed to said internal support member and said plurality of plates, comprising said first side, said second side opposite said first side, and a pair of opposing longitudinal sides;

a first connecting plate assembly hingedly connected to a first side of said main platform;

a second connecting plate assembly hingedly connected to a second side of said main platform; and, a securing means for removably securing said support system to a scaffolding assembly;

wherein said system supports said scaffolding assembly;

wherein said system supports a hoist assembly;

wherein said first and second connecting plate assemblies each extend outwardly from said main platform, thereby providing a torsion and load bearing structure;

wherein said forklift apertures receive a forklift for transportation; and, wherein said system is foldable between a compact state and a deployed state.

2. The system of claim 1, wherein said main platform further comprises:

a hoist mounting plate affixed to a central location of said main platform top plate portion to facilitate mounting of said hoist assembly thereupon;

wherein said hoist mounting plate provides additional torsional strength thereto the main platform.

3. The system of claim 2, wherein said main platform further comprises:

a pair of rigging plates affixed to a central location of said main platform top plate and vertically extending therefrom, each further comprising a securing means aperture;

a pair of anchoring apertures located at intermediate positions adjacent to said longitudinal sides; and, a storage box affixed adjacent to said first side of said main platform top plate;

wherein said pair of anchoring apertures provide an anchoring and attachment means for equipment used with said system.

4. The system of claim 1, wherein said first connecting plate assembly and said second connecting plate assembly are each hingedly attached to said main platform with a pair of heavy-duty three-element rotating units having an interior rotating pin being enclosed therein horizontal cylindrical sleeves.

5. The system of claim 1, wherein said first connecting plate assembly comprises a box structure further comprising:

a first top plate having a rear side extending from and coplanar with said first side of said main platform, said rear side hingedly connected to said main platform;

a first face plate perpendicularly affixed to said first top plate extending downwardly therefrom;

a pair of first outriggers hingedly affixed to opposing ends of a front side of said first face plate and extending horizontally outwardly therefrom;

a pair of bar apertures adjacent to each of said pair of first outriggers;

a plurality of first locking ears affixed to a central location of said front side of said first face plate and forwardly outwardly extending therefrom, further comprising a securing means aperture; and, a pair of handrail mounts affixed to upper outer corners of said first face plate and vertically extending therefrom;

wherein said first face plate is positioned parallel to and adjacent to a vertical side portion of said scaffolding assembly when in said deployed state;

wherein said first face plate is removably attached to said scaffolding assembly with said pair of first outriggers and said plurality of first locking ears; and, wherein said pair of handrail mounts removably receive and secure a safety railing portion of said scaffolding assembly.

6. The system of claim 5, wherein said pair of first outriggers each further comprises:

an outrigger hinge;

an outrigger arm;

a plurality of bar apertures equidistantly-spaced at positions along said outrigger arm; and, a plurality of third locking ears affixed thereto a front side of said outrigger arm and outwardly extending therefrom, further comprising a securing means aperture;

wherein said outrigger hinge hingedly attaches said outrigger arm to said first face plate between a deployed state coplanar with said first face plate and said compact state.

7. The system of claim 5, wherein said pair of second outriggers each further comprises:

an outrigger hinge;

an outrigger arm;

a plurality of bar apertures equidistantly-spaced at positions along said outrigger arm; and, a plurality of third locking ears affixed thereto a front side of said outrigger arm and outwardly extending therefrom, further comprising a securing means aperture;

wherein said outrigger hinge hingedly attaches said outrigger arm to said second face plate between a deployed state coplanar with said second face plate and said compact state.

8. The system of claim 1, wherein said second connecting plate assembly comprises ramp structure further comprises:

a second top plate, comprising a front side, a rear side, and a pair of opposing longitudinal sides, said front side hingedly connected to said main platform;

a pair of inclined planes angled downwardly from said pair of longitudinal sides;

a second face plate perpendicularly affixed to said rear side of said second top plate and extending downwardly therefrom;

a pair of second outriggers hingedly affixed to opposing ends of a rear side of said second face plate and extending horizontally outwardly therefrom;

a pair of bar apertures adjacent to each of said pair of second outriggers;

a plurality of second locking ears affixed to a central location of said rear side of said second face plate and rearwardly outwardly extending therefrom, further comprising a securing means aperture; and, a pair of handrail mounts affixed to upper outer corners of said second face plate and vertically extending therefrom;

wherein said second face plate is positioned parallel to and adjacent to a vertical side portion of said scaffolding assembly when in said deployed state;

wherein said second face plate is removably attached to said scaffolding assembly with said pair of second outriggers and said plurality of second locking ears; and, wherein said pair of handrail mounts removably receive and secure a safety railing portion of said scaffolding assembly.

9. The system of claim 1, wherein said securing means further comprises:

a plurality of locking rods inserted in a plurality of aligned securing means apertures located on a plurality of locking ears located on said main platform, said first connecting assembly, and said second connecting assembly; and, a plurality of pins securing said locking rods to said scaffolding assembly;

wherein said plurality of locking rods are inserted in a correspondingly aligned locking rod apertures of said scaffolding assembly; and, wherein said plurality of pins secure said plurality of locking rods, thereby securing said system to said scaffolding assembly.

10. The system of claim 1, further comprising a plurality of wheel assemblies removably attached to said system when in said compact state.

11. A support system for construction equipment, foldable between a deployed state and a compact state, further comprising:

a main platform, further comprising:

an internal support member comprising a section of structural tubing;

a plurality of plates forming a rectangular structure arranged to form forklift apertures along side surfaces of said main platform;

a main platform top plate affixed thereto said internal support member and said plurality of plates, comprising a first side, a second side opposite said first side, and a pair of opposing longitudinal sides;

a pair of rigging plates affixed to a central location of said main platform top plate and vertically extending therefrom, each further comprising a securing means aperture;

a pair of anchoring apertures located at intermediate positions adjacent to said longitudinal sides; and, a storage box affixed adjacent to said first side of said main platform top plate;

a first connecting plate assembly, further comprising:

a first top plate having a rear side hingedly connected to, extending from, and coplanar with said first side of said main platform;

a first face plate perpendicularly affixed to said first top plate extending downwardly therefrom;

a pair of first outriggers hingedly affixed to opposing ends of a front side of said first face plate and extending horizontally outwardly therefrom;

a pair of bar apertures adjacent to each of said pair of first outriggers;

a plurality of first locking ears affixed to a central location of said front side of said first face plate and forwardly outwardly extending therefrom, further comprising a securing means aperture; and, a pair of handrail mounts affixed to upper outer corners of said first face plate and vertically extending therefrom;

wherein said first face plate is positioned parallel to and adjacent to a vertical side portion of said scaffolding assembly when in said deployed state;

wherein said first face plate is removably attached to said scaffolding assembly with said pair of first outriggers and said plurality of first locking ears; and, wherein said pair of handrail mounts removably receive and secure a safety railing portion of said scaffolding assembly;

a second connecting plate assembly further comprising:

a second top plate, comprising a front side hingedly connected to said main platform, a rear side, and a pair of opposing longitudinal sides;

a pair of inclined planes angled downwardly from said pair of longitudinal sides of said second top plate;

a second face plate perpendicularly affixed to said rear side of said second top plate and extending downwardly therefrom;

a pair of second outriggers hingedly affixed to opposing ends of a rear side of said second top plate and extending horizontally outwardly therefrom;

a pair of bar apertures adjacent to each of said pair of second outriggers;

a plurality of second locking ears affixed to a central location of said rear side of said second face plate and rearwardly outwardly extending therefrom, further comprising a securing means aperture; and, a pair of handrail mounts affixed to upper outer corners of said second face plate and vertically extending therefrom;

wherein said second face plate is positioned parallel to and adjacent to a vertical side portion of said scaffolding assembly when in said deployed state;

wherein said second face plate is removably attached to said scaffolding assembly with said pair of second outriggers and said plurality of second locking ears; and, wherein said pair of handrail mounts removably receive and secure a safety railing portion of said scaffolding assembly; and, a securing means for removably securing said support system to a scaffolding assembly;

wherein said system supports a scaffolding assembly;

wherein said system supports a hoist assembly; and, wherein said first and second connecting plate assemblies each extend outwardly from said main platform, thereby providing a torsion and load bearing structure.

12. The system of claim 11, wherein said pair of first outriggers and said pair of second outriggers each further comprises:

an outrigger hinge;

an outrigger arm;

a plurality of bar apertures equidistantly-spaced at positions along said outrigger arm; and, a plurality of third locking ears affixed thereto a front side of said outrigger arm and outwardly extending therefrom, further comprising a securing means aperture;

wherein said outrigger hinge of said first pair of outriggers hingedly attaches said outrigger arm to said first face plate between a deployed state coplanar with said first face plate and said compact state; and, wherein said outrigger hinge of said second pair of outriggers hingedly attaches said outrigger arm to said second face plate between a deployed state coplanar with said second face plate and said compact state.

13. The system of claim 12, wherein said securing means further comprises:

a plurality of locking rods inserted in aligned securing means apertures of said first locking ears, said second locking ears, and said third locking ears; and, a plurality of pins securing said locking rods to said scaffolding assembly;

wherein said plurality of locking rods are inserted in a correspondingly aligned locking rod apertures of said scaffolding assembly; and, wherein said plurality of pins secure said plurality of locking rods, thereby securing said system to said scaffolding assembly.

14. The system of claim 13, wherein said first connecting plate assembly and said second connecting plate assembly are each hingedly attached to said main platform with a pair of heavy-duty three-element rotating units having an interior rotating pin being enclosed therein horizontal cylindrical sleeves.

15. The system of claim 13, wherein said main platform further comprises:

a hoist mounting plate affixed to a central location of said main platform top plate portion to facilitate mounting of said hoist assembly thereupon;

wherein said hoist mounting plate provides additional torsional strength thereto the main platform.

16. The system of claim 13, further comprising a plurality of wheel assemblies removably attached to said system when in said compact state.

17. A method of removably attaching a support system to a mast climbing scaffolding assembly comprises the following steps:

providing said system, further comprising:

a main platform;

a first connecting plate assembly hingedly connected to a first side of said main platform;

a second connecting plate assembly hingedly connected to a second side of said main platform; and, a securing means for removably securing said support system to a scaffolding assembly;

mounting a hoisting device to a hoist mounting plate on a main platform top plate of said main platform;

hingedly motioning said first connecting plate assembly and said second connecting plate assembly upwardly, thereby providing a compact state;

hoisting said system thereupon a mast climbing scaffolding assembly by inserting a fork of a forklift into forklift apertures of said main platform;

positioning said system to a desired position on said mast climbing scaffolding assembly;

pivoting a pair of first outriggers outwardly about a pair of outrigger hinges of said first connecting plate assembly to a coplanar orientation with a first face plate;

pivoting a pair of second outriggers outwardly about a pair of outrigger hinges of said second connecting plate assembly to a coplanar orientation with a second face plate;

hingedly deploying said first connecting plate assembly from said compact state to a deployed state coplanar with said main platform such that said pair of first outriggers are positioned parallel and adjacent thereto inner and outer vertical faces of said mast climbing scaffolding assembly;

hingedly deploying said first connecting plate assembly from said compact state to a deployed state coplanar with said main platform such that said pair of second outriggers are positioned parallel and adjacent thereto inner and outer vertical faces of said mast climbing scaffolding assembly;

inserting and securing at least one locking bar into a plurality of aligned securing means apertures of a plurality of locking ears of said first connecting plate assembly thereto an anchoring bar of said mast climbing scaffolding assembly; and, inserting and securing at least one locking bar into a plurality of aligned securing means apertures of a plurality of locking ears of said second connecting plate assembly thereto an anchoring bar of said mast climbing scaffolding assembly.

18. The method of claim 17, further comprising the steps of:

attaching a plurality of wheel assemblies to said system when in said compact state; and, transporting said system to a desired location with said plurality of wheel assemblies.

19. The method of claim 17, further comprising the steps of:

anchoring said system with an anchoring means through a securing means aperture of a pair of rigging plates on said main platform; and, anchoring said system with an anchoring means through a pair of anchoring apertures of said main platform.

* * * * *